US010634475B2

(12) United States Patent
Guyon et al.

(10) Patent No.: US 10,634,475 B2
(45) Date of Patent: Apr. 28, 2020

(54) FIRE CONTROL UNIT FOR A SET OF DETONATORS AND FIRING SYSTEM

(71) Applicant: DAVEY BICKFORD, Hery (FR)

(72) Inventors: Franck Guyon, Auxerre (FR); Samir Bouamar, Bassou (FR)

(73) Assignee: DAVEY BICKFORD, Hery (FR)

( * ) Notice: Subject to any disclaimer, the term of this patent is extended or adjusted under 35 U.S.C. 154(b) by 0 days.

(21) Appl. No.: 16/314,818

(22) PCT Filed: Jun. 29, 2017

(86) PCT No.: PCT/FR2017/051750

§ 371 (c)(1),
(2) Date: Jan. 2, 2019

(87) PCT Pub. No.: WO2018/007724

PCT Pub. Date: Jan. 11, 2018

(65) Prior Publication Data

US 2019/0310062 A1 Oct. 10, 2019

(30) Foreign Application Priority Data

Jul. 4, 2016 (FR) ..... 16 56373

(51) Int. Cl.
*F42D 1/055* (2006.01)

(52) U.S. Cl.
CPC ..... *F42D 1/055* (2013.01)

(58) Field of Classification Search
CPC ..... F42D 1/05; F42D 1/055; F42D 1/043
USPC ..... 89/27.11, 28.05; 102/200, 202.9, 217
See application file for complete search history.

(56) References Cited

U.S. PATENT DOCUMENTS 4,208,966 A * 6/1980 Hart ..... E21B 43/11857 102/310
4,884,506 A * 12/1989 Guerreri ..... F42C 11/06 102/200
9,366,518 B2 * 6/2016 Guyon ..... F42D 1/06
2005/0015473 A1 * 1/2005 Teowee ..... F42D 1/05 709/223

FOREIGN PATENT DOCUMENTS

FR 2 984 484 A1 6/2013
WO 2006/094358 A1 9/2006
WO 2007/143759 A1 12/2007
WO 2008/094060 A2 8/2008
WO 2011/140571 A1 11/2011

OTHER PUBLICATIONS

International Search Report, dated Sep. 15, 2017, from corresponding PCT/FR2017/051750 application.

* cited by examiner

*Primary Examiner* — Samir Abdosh
(74) *Attorney, Agent, or Firm* — Young & Thompson

(57) ABSTRACT

A fire control unit includes a control module and first terminals that are designed to receive a firing line to which a set of electronic detonators is linked additionally includes second terminals that are designed to receive a synchronization line to which a second fire control unit is linked, and a switch that may be configured according to multiple configurations such that the controller may be connected to or disconnected from the first terminals or the second terminals, respectively, and that the first terminals and the second terminals may be connected to or disconnected from one another.

20 Claims, 4 Drawing Sheets

Fig. 1
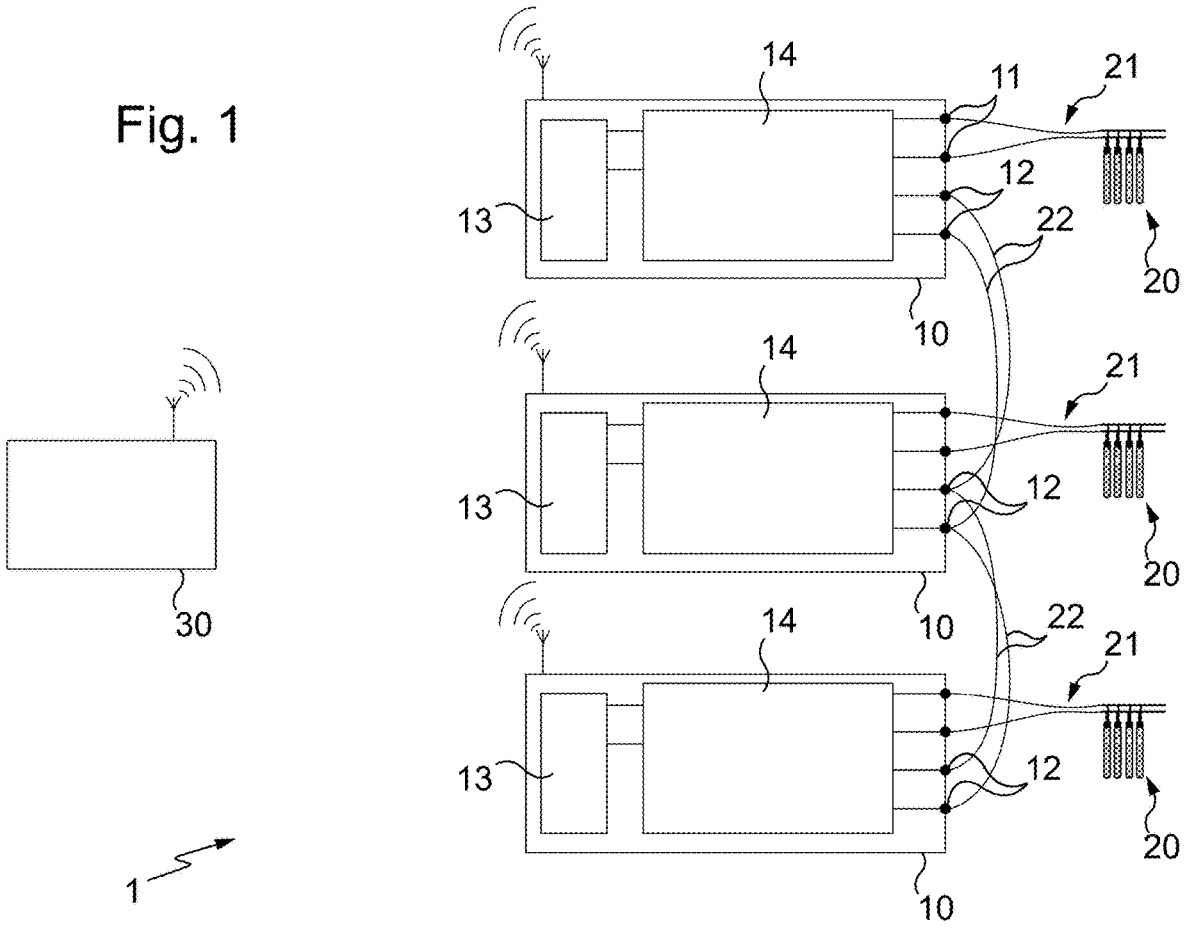
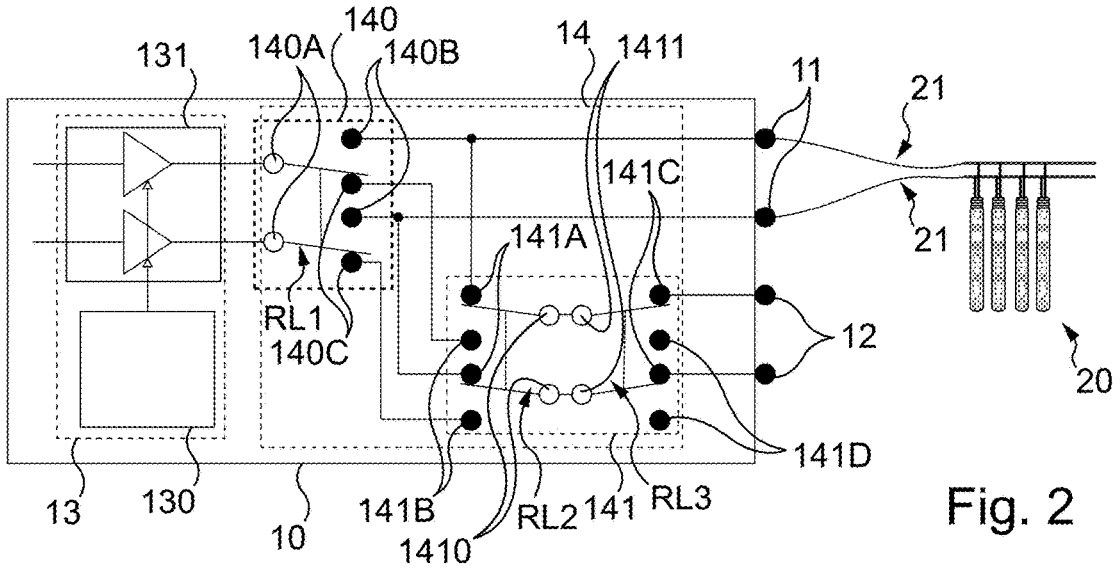
Fig. 2

FIRE CONTROL UNIT FOR A SET OF DETONATORS AND FIRING SYSTEM

The present invention concerns a firing control unit for a set of detonators, as well as a system and method for firing at least two sets of detonators.

The present invention generally concerns the field of works with explosives implementing a very high number of electronic detonators triggered in a precise time sequence.

In a firing system, a set of electronic detonators is associated with a firing control unit. In particular, a set of electronic detonators is connected to a firing line which is linked to a firing control unit. The firing control unit is designed to execute testing phases to check the proper operation of each electronic detonator associated with it, as well as a phase of actual firing of the set of electronic detonators.

The number of electronic detonators able to be linked to a same firing line is limited, this number being for example of the order of 1500 electronic detonators.

Thus, when a greater number of electronic detonators is required, the firing system comprises several firing control units with which there are respectively associated several sets of electronic detonators. The operation of the firing control units is controlled by a remote firing control unit, the firing control units being in other words local firing control units.

For the firing of the sets of electronic detonators, the remote firing control unit sends in synchronized manner a firing instruction to the local firing control units, each local firing control unit then sending onward the firing command to the set of the electronic detonators associated with it.

However, although the remote firing control unit sends the firing instructions in a synchronized manner, the firing commands can arrive at the local firing control units at different times on account of the different propagation delays between the remote firing control unit and each local firing control unit. Thus the firing of each set of detonators may be carried out in unsynchronized manner.

The document FR 2 984 484 describes a solution for synchronized firing, of sets of electronic detonators respectively linked to local firing control units. One unit is selected from the local firing control units as master firing control unit, the other local firing control units being slave local firing control units. In this document, each local firing control unit comprises a synchronizing electronic module connected to a firing line linking a set of electronic detonators to the master local firing control unit. Thus, in such an arrangement, when the master local firing control unit sends a firing instruction to the set of the electronic detonators associated with it, the synchronizing electronic module in each slave local firing control unit also receives the firing instruction. On reception of the firing instruction, the slave local firing control units carry out the firing of the detonators which are respectively associated with it.

The selection of the master firing control unit is made by an operator when cabling the various elements forming the firing system. Thus, the cabling must be carried out by taking into account the role of master or slave of each firing control unit. Once the elements of the system have been connected together, the role of master or of slave of the firing control units cannot be changed, except by re-doing the cabling.

The present invention is directed to providing a firing control unit for a set of detonators enabling the configuration of a firing system to be made more flexible.

To that end, according to a first aspect, the present invention concerns a firing control unit comprising a control module and first terminals designed to receive a firing line to which is linked a set of electronic detonators.

According to the invention, the firing control unit further comprises second terminals designed to receive a synchronization line to which is linked a second firing control unit, and switching means able to be configured in several configurations such that the control means can be connected to or disconnected from the first terminals or the second terminals respectively, and the first terminals and the second terminals can be connected to or disconnected from each other.

Thus, the firing control unit can have different configurations according to the configuration of the switching means.

Therefore, by configuring the switching means, the firing control unit can be configured once installed in a firing system, that is to say once linked to the other elements forming a firing system. Furthermore, the configuration of the firing control unit may be modified, for example according to the operation which is to be carried out in a firing system, without requiring the cabling to be modified by an operator.

It may for example be configured as master or slave firing control unit by virtue of the switching means, or have a configuration suitable for carrying out testing phases.

According to a feature, the switching means can be configured such that the control module is connected to the first terminals, the first and second terminals being connected together, or such that the control module is disconnected from the first terminals and from the second terminals, the first and second terminals being connected together.

Thus, according to a first configuration of the switching means, the control module is linked to the first terminals, these first terminals enabling the connection of a firing line to which is linked a set of electronic detonators. Furthermore, according to this first configuration of the switching means, the first terminals and the second terminals are connected together, the second terminals enabling the connection of a synchronization line to which is connected a second firing control unit.

In this first configuration, the control module of the firing control unit controls the operation of the set of detonators linked to the firing control unit and of the set of detonators linked to the second firing control unit.

According to a second configuration of the switching means, the control module is disconnected from the first terminals and the first terminals are linked to the second terminals.

According to another feature, the switching means can be configured such that the control module is linked to the second terminals, the first terminals and the second terminals being disconnected from each other.

In this configuration, no voltage at the second terminals is transferred to the first terminals.

According to still another feature, the switching means can be configured such that the control module is linked to the first terminals, the first terminals and the second terminals being disconnected from each other.

This configuration can be used to carry out tests on a set of detonators which could become connected to the first terminals.

According to a feature, the switching means comprise a first switching module and a second switching module, the first switching module enabling the connection of the control module to the first terminals or to the second switching module, and the second switching module enabling the first switching module to be connected to or disconnected from the second terminals.

Thus, according to the configurations of the switching means, the control module may be connected to the first terminals and/or to the second terminals, and the first terminals and the second terminals may be connected together or disconnected.

According to a feature, in one configuration of the switching means, the first switching module is configured in order for the control module to be connected to the first terminals and the second switching module is configured in order for the first terminals and the second terminals to be connected together.

In this configuration, the control module, the first terminals and the second terminals are linked together.

According to another feature, in a second configuration of the switching means, the first switching module is configured in order for the control module to be disconnected from the first terminals and the second switching module is configured in order for the first terminals and the second terminals to be connected together.

For example, the switching means comprise electro-mechanical relays.

According to a second aspect, the present invention concerns a system for firing at least two sets of detonators comprising at least two firing control units, each firing control unit comprising first terminals receiving a firing line to which is linked a set of detonators.

According to the invention, said at least two firing control units are connected together via a synchronization line, each firing control unit comprising second terminals receiving the synchronization line, it being possible for a control module and switching means to be configured in several configurations such that the control means can be connected to or disconnected from the first terminals or the second terminals respectively, and the first terminals and the second terminals can be connected together or disconnected from each other.

Thus, thanks to the switching means in each firing control unit, the firing system can be configured once the different constituent elements are linked together. In particular, the configuration (or operating mode) of each firing control unit can be established once the elements forming the firing system are linked together and even be modified without requiring the elements to be disconnected and reconnected.

According to a feature, the switching means of a master firing control unit can be configured such that the control module is connected to the first terminals, and such that the first terminals and the second terminals are connected together, and the switching means of a slave firing control unit can be configured such that the control module is disconnected from the first terminals and from the second terminals, and such that the first terminals and the second terminals are connected together.

Thus, in the first firing control unit, on account of the configuration of the switching means, the set of detonators linked to the first terminals is connected to the control module, this first firing control unit thus managing the operation of the set of electronic detonators which is associated with it. This set of electronic detonators is furthermore linked via the second terminals and the synchronization line to the second firing control unit, in particular to the second terminals of that second firing control unit.

In the second firing control unit, on account of the configuration of the switching means, the set of detonators linked to the first terminals is connected to the second terminals, and the control module is disconnected from the first terminals.

Thus, the set of detonators connected to the first firing control unit is linked to the set of detonators connected to the second firing control unit and the control module of the first firing control unit is linked to the sets of detonators respectively associated with the first firing control unit and with the second firing control unit, the firing of the sets of detonators being carried out with a unique firing instruction issued by the first firing control unit.

Thus, the first firing control unit has a role of a master firing control unit and the second firing control unit has a role of a slave firing control unit.

According to one feature, the switching means of said at least two firing control units can be configured such that the control module is linked to the first terminals, the first terminals and the second terminals being disconnected from each other.

In such a configuration, the control module of each firing control unit is connected to the set of detonators linked to the first terminals, the control module of each control unit managing the operation of the set of detonators linked to the first terminals. This configuration can for example be used at the detonator testing phase.

According to one feature, the switching means of said at least two firing control units can be configured such that the control module is linked to the second terminals, the first terminals and the second terminals being disconnected from each other.

In such a configuration, the control module of the firing control units is linked to the second terminals, the second terminals of the firing control units being linked together. As the second terminals and the first terminals are disconnected from each other, voltages present on the synchronization line linking the control units by the second terminals are not sent to the firing lines to which the sets of detonators are respectively linked.

Thus, the propagation on the firing line of a voltage present at the second terminals would be avoided.

According to one feature, the firing control units are linked by radio to a remote firing control unit.

According to a third aspect, the present invention concerns a method of firing at least two sets of detonators in a firing system, the firing system comprising at least two firing control units, each firing control unit comprising first terminals receiving a firing line to which is linked a set of detonators, second terminals, a control module and switching means, said at least two firing control units being connected together via a synchronization line linked to said second terminals, said method of configuration comprising the configuration of said at least two firing control units in a configuration, said configuration of said at least two firing control units comprising positioning the switching means such that the control means can be connected to or disconnected from the first terminals or the second terminals respectively, and such that the first terminals and the second terminals can be connected together or disconnected from each other.

The connection of the control module, of the first terminals and of the second terminals of each control unit is configured by virtue of positioning the switching means, this positioning being implemented when the two sets of detonators are respectively connected to the two firing control units, the two firing control units being linked together.

According to a feature, the method comprises the configuration of the firing control units in a coupling configuration comprising:

positioning the switching means of a master firing control unit such that said control module is connected to said first terminals, and such that said first terminals and said second terminals are connected together; and positioning the switching means of a slave firing control unit such that the control module is disconnected from the first terminals and from the second terminals, and such that the first terminals and the second terminals are connected together.

Thus, by virtue of the method, the switching means of the first firing control unit are positioned such that the firing control unit has the role of master firing control unit and the switching means of the second firing control unit are positioned such that it has the role of slave firing control unit.

According to another feature, the method comprises configuring the firing control units in a testing configuration comprising positioning the switching means of the firing control units such that the control module is linked to said second terminals, the first terminals and the second terminals being disconnected from each other.

The firing system and the method of firing have similar advantages to those described above with reference to the firing control unit according to the invention.

Still other particularities and advantages of the invention will appear in the following description.

In the accompanying drawings, given by way of non-limiting example:

FIG. 1 is a diagrammatic illustration of a firing system with several sets of electronic detonators according to an embodiment of the invention;

FIG. 2 is a diagram illustrating a firing control unit according to an embodiment of the invention;

Figure 3:
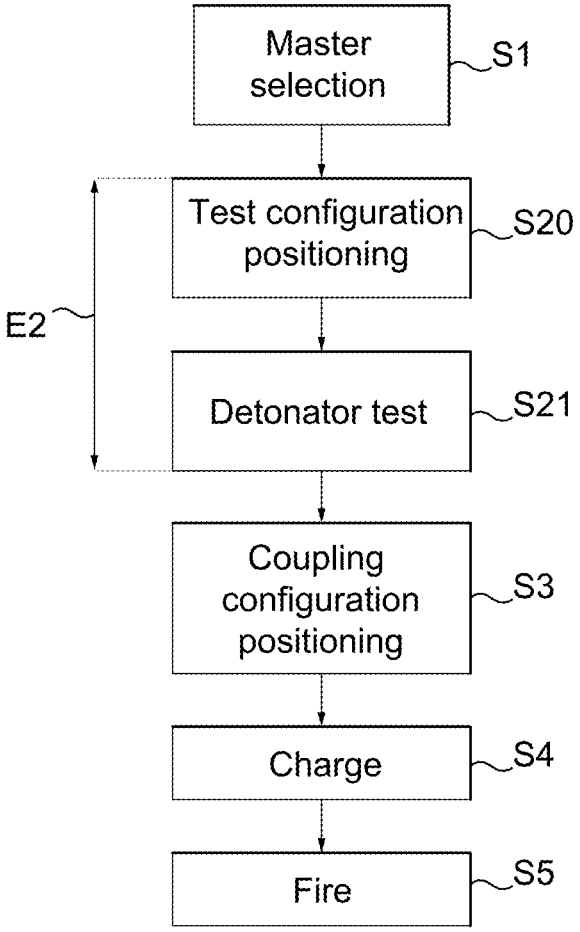
FIG. 3 illustrates a flowchart representing the method of configuring a firing system according to an embodiment of the invention.

FIG. 1 represents a firing system 1 comprising several firing control units 10 and several sets of detonators 20, each set of detonators 20 being associated with a firing control unit 10.

In the embodiment represented in FIG. 1, the firing system comprises three firing control units as well as three sets of detonators 20.

Of course, the number of firing control units and of the sets of detonators may be different.

The firing system further comprises a remote firing control unit 30 controlling the operation of the firing control units 10.

The firing control units 10 are thus local firing control units.

In the embodiment represented, the electronic detonators of a set of electronic detonators 20 are linked in parallel on a firing line 21, the firing line being connected to a firing control unit 10.

The number of electronic detonators of a set of electronic detonator 20 linked in parallel on the same firing line 21 may vary and for example be up to 1500 electronic detonators.

The electronic detonators 20 are designed to dialog with the firing control unit 10, the firing control unit 10 managing their operation and supplying them.

Each firing control unit 10 comprises first terminals 11 designed to receive a firing line 21 to which is linked a set of electronic detonators 20, and second terminals 12 designed to receive a synchronization line 22 to which is linked a second firing control unit 10.

The firing control units 10 are thus linked together, by means of a synchronization line 22.

Thus, a synchronization line 22 is linked to the second terminals 12 of two firing control units 10.

Each firing control unit 10 further comprises control means 13 managing its operation, as well as the operation of the detonators 20 which are linked to it.

Each firing control unit 10 further comprises switching means 14 which may be configured in several configurations.

As will be described in more detail with reference to FIG. 2, according to the configuration in which the switching means 14 are configured, the control module 13 can be connected to or disconnected from the first terminals 11 and the second terminals 12, and the first terminals 11 and second terminals 12 can be connected together or disconnected from each other.

Thus, the firing control unit 10 can have different configurations according to the configuration of the switching means 14.

As will be described below, each firing control unit 10 can be configured with different configurations, for example according to the operating phase or the operation to be carried out by the firing system 1.

Configurations of the switching means and of the firing control unit will be described below.

A firing control unit according to one embodiment is represented in FIG. 2.

A firing control unit 10 comprises a control module 13. The control module 13 is configured in particular to communicate with the electronic detonators 20 that are associated with the firing control unit 10, as well as to supply them.

In one embodiment, the control module 13 comprises electronic circuits such as a microcontroller 130, managing the operation of the firing control unit 10, in particular of the control module 13. The control module 13 further comprises control devices 131 making it possible to supply or not to supply the electronic detonators 20. The control devices 131 comprise for example power amplifiers.

Thus, for example, the microcontroller 130 of the control module 13 sends control signals to the control devices 131 in order to activate or not activate the outputs of the power amplifiers enabling the set of detonators 20 to be supplied or not supplied.

Furthermore, the firing control unit 10 comprises switching means 14.

In one embodiment, the switching means 14 comprise a first switching module 140 and a second switching module 141.

In the embodiment described, the first switching module 140 is disposed between the control module 13 and the second switching module 141. Thus, the first switching module 140 links the output of the control module 13 to the first terminals 11 or to the input of the second switching module 141.

The second switching module 141 is disposed between the first switching module 140, and the second terminals 12. Thus, the second switching module 141 can link the output 140B, 140C of the first switching module 140 to the second terminals 12.

In the embodiment represented, the first switching module 140 comprises a first electromagnetic relay RL1 and an input 140A receiving the output from the control module 13, and from the first and second outputs 140B, 140C.

It will be noted that the input from the first electromagnetic relay RL1 corresponds to the input 140A of the first switching module 140 and that the outputs correspond to the outputs 140B, 140C of the first switching module 140.

The second switching module 141 comprises in this embodiment, first and second inputs 141A, 141B and first and second outputs 141C, 141D.

The first output 140B and the second output 140C of the first switching module 140 corresponds to the inputs 141A, 141B of the second switching module 141.

In particular, in the described example embodiment, the first output 140B of the first switching module 140 is linked to the first input 141A of the second switching module 141.

Furthermore, the second output 140C of the first switching module 140 is linked to the second input 141B of the second switching module 141.

Furthermore, the first output 140B of the first switching module is linked to the first terminals 11.

The second switching module 141 can, according to its configuration, connect to or disconnect from the second terminals 12, the output of the first switching module 140 and connect or disconnect the first terminals 11 to or from the second terminals 12.

Thus, when the first electromagnetic relay RL1 is in a first position (not shown), the control module 13 is linked to the first input 141A of the second switching module 141 and to the first terminals 11.

When the first electromagnetic relay RL1 is in a second position (position represented in FIG. 2), the control module 13 is linked to the second input 141B of the second switching module 141 and disconnected from the first terminals 11.

Thus, according to the configuration of the second switching module 141, the control module 13 can be connected to or disconnected from the second terminals 12 and the first terminals 11 can be connected to or disconnected from the second terminals 12.

In the embodiment represented, the second switching module 141 comprises a second and a third electromagnetic relay RL2, RL3.

The second electromagnetic relay RL2 links the first input 141A or the second input 141B of the second switching module 141 to an output 1410.

The third electromagnetic relay RL3 links its output 1411 to the first output 141C or to the second output 141D of the second switching module 141. The input 1411 is linked here to the output 1410 of the second electromagnetic relay RL2.

Thus, the inputs of the second electromagnetic relay RL2 correspond to the first and second inputs 141A, 141B of the second switching module 141 and the first output 141C and the second output 141D of the second switching module 141 correspond to the outputs of the third electromagnetic relay RL3.

In the embodiment described, the first output 141C of the second switching module 141 is linked to the second terminals 12 of the firing control unit 10.

Thus, the second electromagnetic relay RL2 connects or disconnects the outputs 140B, 140C of the first switching module 140 to or from the third electromagnetic relay RL3, this third electromagnetic relay RL3 connecting or disconnecting the output 1410 of the second electromagnetic relay RL2 to or from the second terminals 12.

In particular, when the second electromagnetic relay RL2 is in a first position (that represented in FIG. 2), the first output 140B of the first switching module 140 is linked to the third electromagnetic relay RL3. As this first output 140B is linked to the first terminals 11, the first terminals 11 are thus linked to the third electromagnetic relay RL3.

When the second electromagnetic relay RL2 is in a second position (not shown), the second output 140C of the first switching module 140 is linked to the third electromagnetic relay RL3.

When the third electromagnetic relay RL3 is in a first position (represented in FIG. 2), the output from the second electromagnetic relay RL2 is linked to the second terminals 12. That is to say that either the first output 140B, or the second output 140C of the first switching module 140 is linked to the second terminals 12.

When the third electromagnetic relay RL3 is in a second position (not shown), the second terminals 12 are disconnected, that is to say that none of the outputs 140B, 140C of the first switching module 140 is linked to the second terminals 12.

Therefore, by virtue of the various possible configurations of the electromagnetic relays RL1, RL2, RL3 in the switching modules 140, 141, the firing control unit 10 can have several configurations.

Thus, for example, the firing control units in a firing system can be configured according to the operation which has to be carried out by the firing system without however having to disconnect the firing control units 10 from each other.

Figure 4A:
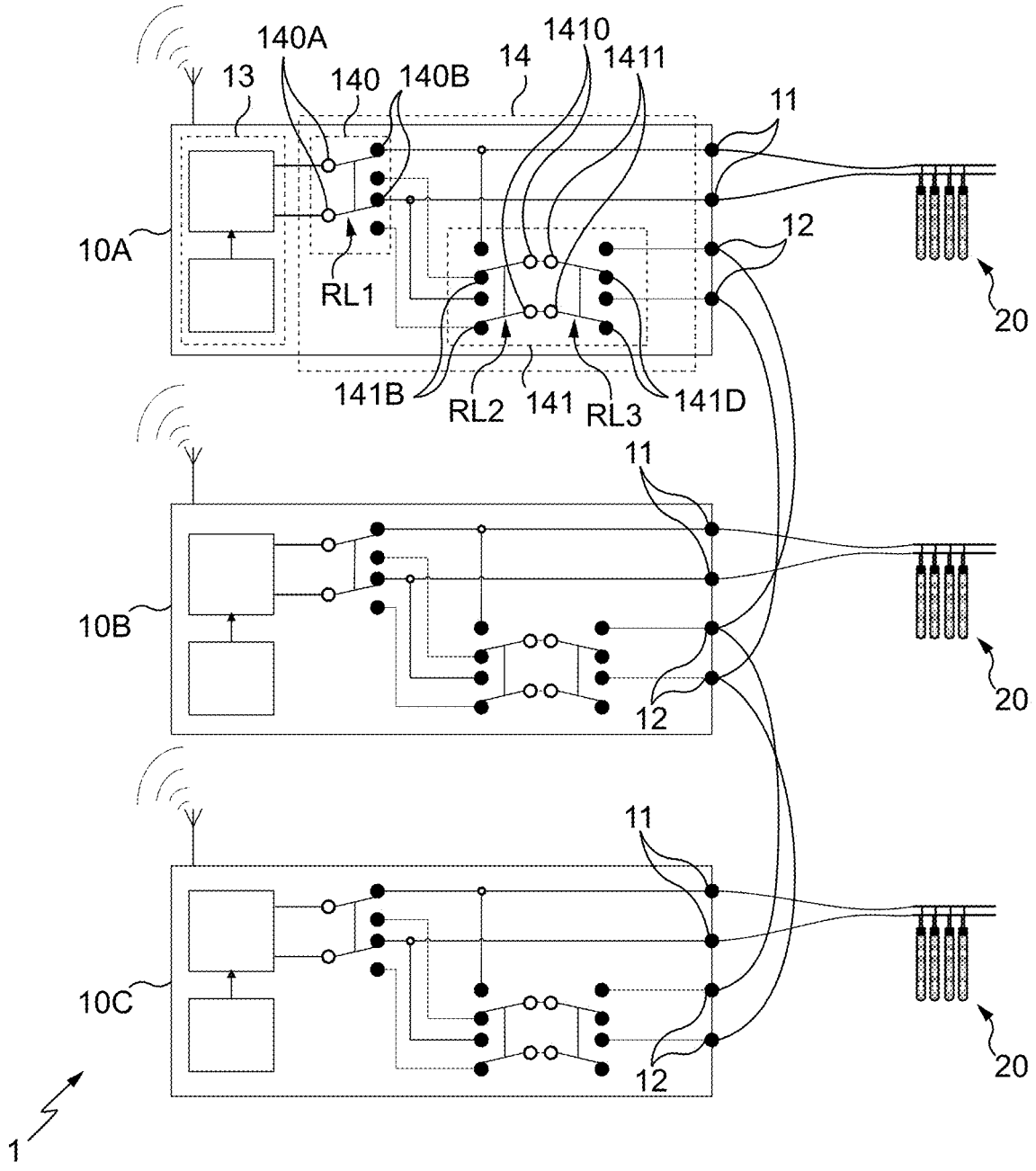
FIGS. 4A and 4B represent configurations of a firing system according to an embodiment of the invention.
Figure 4B:
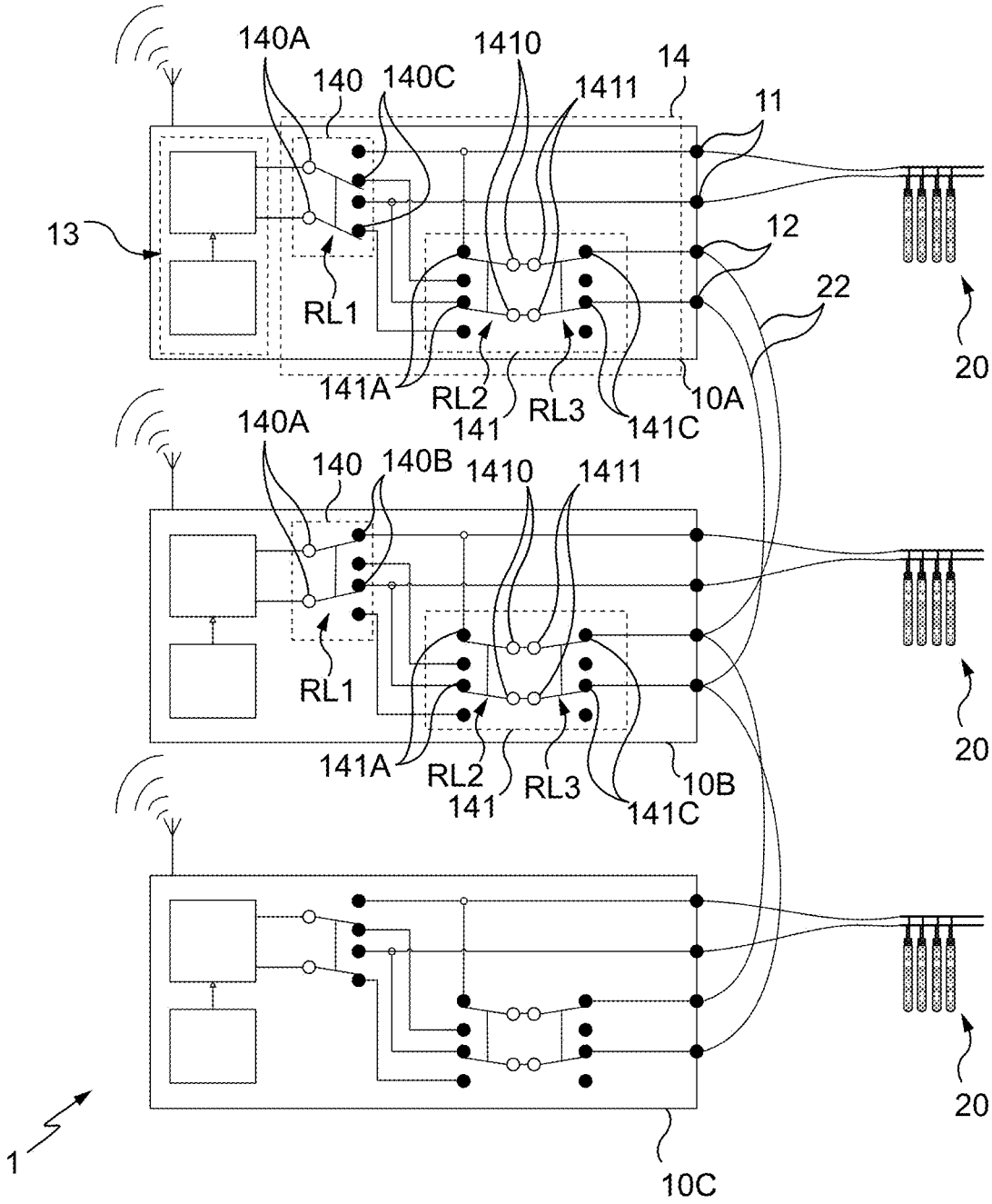

For example, as will be described below, when the firing system is going to carry out a testing phase for the detonators, the firing control units 10 are configured as represented in FIG. 4A, and when the firing of the sets of detonators 20 is to be carried out, the firing control units 10 are configured as is represented in FIG. 4B. FIGS. 4A and 4B will be described later.

Once the sets of detonators 20 have been linked to the firing control units 10 respectively and the firing control units 10 have been linked together pairwise by means of synchronization lines 22, a method for firing the detonators 20 such as that represented in FIG. 3 can be implemented.

Thus, according to the operation carried out in the firing method, the firing control units have different configurations (as represented for example in FIGS. 4A and 4B).

FIG. 3 illustrates a firing method in accordance with one embodiment. The method is carried out once tests (for example self-tests) of the integrity of the elements composing each firing control unit 10 have been carried out.

The method comprises a step S1 of selecting the firing control unit 10 having a role of master from among the firing control units 10.

In one embodiment, the selected master firing control unit is that occupying the middle position among the firing control units.

In one embodiment such as that represented in FIG. 1, the master firing control unit is that positioned between two firing control units.

It will be noted that a firing control unit is defined as being positioned in the middle when the synchronization lines 22 which link it to the other firing control units have the lowest resistances.

When the resistances are equal, for several firing control units, the master firing control unit corresponds to that having the highest number of detonators connected to the first terminals.

When the number of firing control units in the detonation system is even, there is no unique firing control unit positioned in the middle, but two firing control units.

In this case, the master firing control unit selected is that having the highest number of detonators connected to the first terminals, out of the two firing control units positioned in the middle of the firing control units.

It will be noted that when the detonation system only comprises two firing control units, the selected master firing control unit corresponds to the firing control unit having the highest number of electronic detonators linked the first terminals.

If the number of electronic detonators is identical, the master firing control unit selected is that which was recorded first in the remote firing control unit 30.

In one embodiment, the method comprises a phase S2 of testing the detonators.

During the phase 2 of testing the detonators, each of the firing control units 10 performs the testing of the set of detonators 20 which is associated with it.

Thus, during the testing phase S2, the method comprises a step S20 of positioning in testing configuration of the switching means 14 such that the firing control units 10 are configured in a testing configuration. Thus testing configuration is represented in feature 4A In the step S20 of positioning in testing configuration, the switching means 14 are positioned such that the control module 13 is linked to the first terminals 11, the first terminals 11 and the second terminals 12 being disconnected from each other.

Thus, each firing control unit 10 can manage the operation of the set of detonators 20 linked to the first terminals 11, each firing control unit 10 performing the phase of testing the set of detonators 20 which is associated with it at an actual testing step S21.

The testing of the sets of detonators 20 that are associated respectively with the firing control units 10 is carried out in parallel, the testing step S21 thus being carried out rapidly.

The step S1 of selecting the master firing control unit and the testing phase S2 (comprising the test positioning step S20 and the actual testing step S21), can be carried out in a different order from that represented in FIG. 3.

Of course, in the testing step S2, the test positioning step S20 always precedes the actual testing step S21.

Thus, the testing phase S2 (S20, S21) can be carried out prior to the step S2 of selecting the master firing control unit.

In the embodiment represented, once the testing step S21 has finished, the positioning of each firing control unit 10 in coupling configuration is implemented at a step S3 of positioning in coupling configuration.

It will be noted that the coupling configuration of each firing control unit 10 depends on the role it has in the firing control system, that is to say if it has a role of master or slave firing control unit.

Thus, the step S1 of determining the master firing control unit must be carried out prior to the implementation of the coupling positioning step S3.

It will furthermore be noted that in the coupling configuration, all the sets of detonators 20 are electrically linked, that all the firing lines 21 and the synchronization lines 22 of the firing system are electrically linked, and that all the sets of detonators 20 of the firing system are linked to the control module 13 of a firing control unit 10 which has the role of master firing control unit (10B in FIGS. 4A and 4B).

In the described embodiment, once the coupling configuration has been implemented, the sets of detonators 20 are charged at a charging step S4 and then actually fired at a firing step S5. The charging S4 and the firing S5 are operations known to the person skilled in the art and will not be described here.

In this embodiment, the charging of all the detonators 20 of the system 1 is carried out by the master firing control unit.

According to other embodiments, the charging step is carried out prior to the coupling step. In this case, each firing control unit carries out the charging of the detonators connected to its first terminals.

In the described embodiment, the charging step S4 is carried out once the positioning S3 in coupling configuration has been implemented.

Therefore, the master firing control unit carries out the charging of all the sets of detonators 20, the charging being carried out rapidly. Furthermore, the reliability of the firing is further improved given that the charging of the detonators does not depend on the proper operation of all the firing control units.

FIGS. 4A and 4B diagrammatically represent a detonation or firing system 1 in accordance with one embodiment, comprising three local firing control units 10A, 10B, 10C and three sets of detonators 20.

In the described embodiment, the firing control units 10A, 10B, 100 have an identical structure such as that described with reference to FIG. 2, but have different configurations from each other according to the operating phase of the firing system 1.

In FIG. 4A, the switching means 14 of the firing control units 10A, 10B, 100 are positioned such that the firing control units 10A, 10B, 100 are configured in a testing configuration, and in FIG. 4B, the switching means 14 of the firing control units 10A, 10B, 100 are positioned such that the firing control units 10A, 10B, 100 are configured in a coupling configuration.

In one embodiment, the firing control units 10A, 10B, 100 are in coupling position or configuration when the detonators are going to be charged and fired, once the testing phases have terminated.

Nevertheless, as indicated above in other embodiments, the firing control units 10 may be placed in coupling configuration at any other time.

It will be noted that the remote firing control unit is not represented in FIGS. 4A and 4B.

In FIG. 4A, the switching means 14 of the three firing control units 10A, 10B, 100 are configured such that the control module 13 is linked to the first terminals 11 and the first and second terminals 11, 12 are disconnected from each other.

In particular, the first switching module 140 is configured such that the control module 13 is linked to the first terminals 11 and the second switching module 141 is configured such that the first and second terminals 11, 12 are disconnected from each other. For this, the first relay RL1 is positioned such that the input 140A of the first switching module 140 is linked to the first output 140B of the first switching module 140.

The second relay RL2 is positioned such that the second input 141B of the second switching module 141 is linked to a output 1410 of the second relay RL2. The input 1411 of the third relay RL3 is linked to the second output 141D of the second switching module 141.

In this testing configuration, each firing control unit 10A, 10B, 100 manages the operation of the set of detonators 20 which is respectively associated with it.

Thus, when the testing step S21 is to be carried out, the remote firing control unit 30 controls the local firing control units 10A, 10B, 100 in order for them to be configured in the testing configuration described above.

In an embodiment not shown, the coupling step S3 is carried out prior the testing step S21.

In this embodiment, the step S20 of positioning in test configuration is not carried out.

The firing control units 10A, 10B, 100 of the firing system 1 represented in FIG. 4B are in coupling configuration.

In the coupling configuration, one of the firing control units (10B in the example represented) has a role of master firing control unit and the other firing control units (10A, 100 in the example represented) have a role of slave firing control unit.

Thus, the master firing control unit 10B is the firing control unit which generates the firing command on receiving the instruction to fire issued by the remote firing control unit 30, this firing being unique firing for all the sets of detonators 20. This unique firing reduces the risk of failure to detonate by certain detonators for example on account of a failure of a slave firing control unit.

In order to configure the firing control units 10A, 10B, 100, the switching means 14 of a first firing control unit 10A and a third firing control unit 100 are configured in order for the firing control unit 10A, 10C to have a role of slave firing control unit, and the switching means 14 of a second firing control unit 10B are configured in order for the firing control unit 10B to have a role of master firing control unit.

It will be noted that the firing control unit selected here as the master firing control unit 10B is that which is located in the middle, that is to say between the first firing control unit 10A and the third firing control unit 10C Nevertheless, in other embodiments, another firing control unit can be selected as the master firing control unit.

In the embodiment described, the switching means 14 of the master firing control unit 10B are configured such that the control module 13 is connected to the first terminals 11 and such that the first terminals 11 and the second terminals 12 are connected together.

In this case, the first electromagnetic relay is positioned such that the input 140A of the first switching module 140 is linked to the first output 140B of the first switching module 140.

Furthermore, the second electromagnetic relay RL2 is positioned such that the first input 141A is linked to the output 1410 of the second electromagnetic relay RL2. The input 1411 of the third electromagnetic relay RL3 is linked to the first output 141C of the second switching module 141.

Furthermore, the switching means 14 of the firing control units having a role of slave firing control unit (10A, 10C in FIGS. 4A and 4B) are configured such that the control module 13 of each slave control unit 10A, 100 is disconnected from the first terminals 11 and such that the first terminals 11 and the second terminals 12 are connected together. In particular, the first electromagnetic relay RL1 is positioned such that the input 140A of the first switching module 140 is linked to the second output 140C of the first switching module 140.

Furthermore, the second electromagnetic relay RL2 is positioned such that the first input 141A is linked to the output 1410 of the second electromagnetic relay RL2. The input 1411 of the third electromagnetic relay RL3 is linked to the first output 141C of the second switching module 141.

Thus, the control module 13 of the master firing control unit 10B is linked via the first terminals 11 to the set of detonators 20, the control module 13 and the set of electronic detonators 20 being linked via the second terminals 12 to the second terminals 12 of a slave firing control unit 10A, 10C.

In the slave firing control unit 10A, 100, as the first terminals 11 and the second terminals 12 are linked together, the control module 13 and the set of detonators 20 of the master firing control unit 10B are linked to the set of detonators 20 of the slave firing control unit 10A, 10C.

It will be noted that the control module 13 of the slave firing control units 10A, 100 is disconnected from the first terminals 11, and therefore is disconnected from the set of electronic detonators 20.

Thus, the configuration of the firing control units 10 in a coupling configuration comprises the positioning of the switching means 14 of the master firing control unit 10B such that the control module 13 is connected to the first terminals 11 and such that the first terminals 11 and the second terminals 12 are connected together, and the positioning of the switching means 14 of the slave firing control units 10A, 100 such that the control module 13 is disconnected from the first terminals 11 and such that the first terminals 11 and the second terminals 12 are connected together.

Thus, in summary, in the embodiment represented in FIG. 4B, in the first firing control unit 10A and the third firing control unit 100 (slave firing control units), the switching means 14 are configured such that the control module 13 is disconnected from the first terminals and such that the first terminals 11 and the second terminals 12 are connected together.

In the second firing control unit 10B (master firing control unit), the switching means 14 are configured such that the control module 13 is connected to the first terminals 11 and such that the first terminals 11 and the second terminals 12 are connected together.

The invention claimed is:

1. A firing control unit comprising a control module (13) and first terminals (11) designed to receive a firing line (21) to which is linked a set of electronic detonators (20), the firing control unit (10) further comprising second terminals (12) designed to receive a synchronization line (22) to which is linked a second firing control unit (10), and switching means (14) able to be configured in several configurations such that the control means (13) can be connected to or disconnected from the first terminals (11) or the second terminals (12) respectively, wherein the first terminals (11) and the second terminals (12) can be connected to or disconnected from each other.

2. The firing control unit in accordance with claim 1, wherein said switching means (14) can be configured such that said control module (13) is connected to the first terminals (11), the first terminals (11) and the second terminals (12) being connected together, or such that the control module (13) is disconnected from the first terminals (11) and from the second terminals (12), the first terminals (11) and the second terminals (12) being connected together.

3. The firing control unit in accordance with claim 1, wherein the switching means (14) can be configured such that said control module (13) is linked to the first terminals (11), the first terminals (11) and the second terminals (12) being disconnected from each other.

4. The firing control unit in accordance with claim 1, wherein the switching means (14) can be configured such that said control module (13) is connected to the second terminals (12), the first terminals (11) and the second terminals (12) being disconnected from each other.

5. The firing control unit in accordance with claim 1, wherein the switching means (14) comprise a first switching module (140) and a second switching module (141), said first switching module (140) enabling the connection of said control module (13) to said first terminals (11) or to said second switching module (141), and said second switching module (141) enabling the first switching module (140) to be connected to or disconnected from said second terminals (12).

6. The firing control unit in accordance with claim 1, wherein said switching means (14) comprise electro-mechanical relays (RL1, RL2, RL3).

7. A system for firing at least two sets of detonators (20) comprising at least two firing control units (10A, 10B, 10C), each firing control unit (10A, 10B, 10C) comprising first terminals (11) receiving a firing line (21) to which is linked a set of detonators (20), wherein said at least two firing control units (10A, 10B, 10C) are connected together via a synchronization line (22), each firing control unit (10A, 10B, 10C) comprising second terminals (12) receiving said synchronization line (22), it being possible for a control module (13), and switching means (14) to be configured in several configurations such that the control means (13) can be connected to or disconnected from the first terminals (11) or the second terminals (12) respectively, and the first terminals (11) and the second terminals (12) can be connected together or disconnected from each other.

8. The firing system in accordance with claim 7, wherein said switching means (14) of a master firing control unit (10B) can be configured such that said control module (13) is connected to said first terminals (11), and such that the first terminals (11) and the second terminals (12) are connected together, and the switching means (14) of a slave firing control unit (10A, 10C) can be configured such that said control module (13) is disconnected from said first terminals (11) and from the second terminals (12), and such that said first terminals (11) and said second terminals (12) are connected together.

9. The firing system in accordance with claim 7, wherein the switching means (14) of said at least two firing control units (10) can be configured such that said control module (13) is linked to said first terminals (11), said first terminals (11) and said second terminals (12) being disconnected from each other.

10. The firing system in accordance with claim 7, wherein said switching means (14) of said at least two firing control units (10) can be configured such that said control module (13) is linked to said second terminals (12), said first terminals (11) and said second terminals (12) being disconnected from each other.

11. A method of firing at least two sets of detonators in a firing system (1), the firing system (1) comprising at least two firing control units, each firing control unit comprising first terminals (11) receiving a firing line (21) to which is linked a set of detonators (20), second terminals (12), a control module (13) and switching means (14), said at least two firing control units (10) being connected together via a synchronization line (22) linked to said second terminals (12), said method comprising the configuration (S20, S3) of said at least two firing control units in a configuration, said configuration (S20, S3) of said at least two firing control units comprising positioning the switching means (14) such that the control means (13) can be connected to or disconnected from the first terminals (11) or the second terminals (12) respectively, and such that the first terminals (11) and the second terminals (12) can be connected together or disconnected from each other.

12. The firing method according to claim 11, further comprising (S3) the configuration of the firing control units (10) in a coupling configuration comprising:

positioning the switching means (14) of a master firing control unit (10B) such that said control module (13) is connected to said first terminals (11), and such that said first terminals (11) and said second terminals (12) are connected together; and positioning the switching means (14) of a slave firing control unit (10A, 10C) such that the control module (13) is disconnected from the first terminals (11) and from the second terminals (12), and such that the first terminals (11) and the second terminals (12) are connected together.

13. The firing method according to claim 11, further comprising configuring (S20) the firing control units (10) in a testing configuration comprising positioning the switching means (14) of the firing control units (10A, 10B, 10C) such that the control module is linked to said first terminals (11), said first terminals (11) and said second terminals(12) being disconnected from each other.

14. The firing control unit in accordance with claim 2, wherein the switching means can be configured such that said control module is linked to the first terminals, the first terminals and the second terminals being disconnected from each other.

15. The firing control unit in accordance with claim 2, wherein the switching means can be configured such that said control module is connected to the second terminals, the first terminals and the second terminals being disconnected from each other.

16. The firing control unit in accordance with claim 3, wherein the switching means can be configured such that said control module is connected to the second terminals, the first terminals and the second terminals being disconnected from each other.

17. The firing control unit in accordance with claim 2, wherein the switching means comprise a first switching module and a second switching module, said first switching module enabling the connection of said control module to said first terminals or to said second switching module, and said second switching module enabling the first switching module to be connected to or disconnected from said second terminals.

18. The firing control unit in accordance with claim 3, wherein the switching means comprise a first switching module and a second switching module, said first switching module enabling the connection of said control module to said first terminals or to said second switching module, and said second switching module enabling the first switching module to be connected to or disconnected from said second terminals.

19. The firing control unit in accordance with claim 4, wherein the switching means comprise a first switching module and a second switching module, said first switching module enabling the connection of said control module to said first terminals or to said second switching module, and said second switching module enabling the first switching module to be connected to or disconnected from said second terminals.

20. The firing control unit in accordance with claim 2, wherein said switching means comprise electro-mechanical relays.

* * * * *